US006889397B2

(12) United States Patent
Rosenberg

(10) Patent No.: US 6,889,397 B2
(45) Date of Patent: May 10, 2005

(54) DIAPER CHANGING APPARATUS

(76) Inventor: Frank Rosenberg, 18 Echo Hill La., Moraga, CA (US) 94556

( * ) Notice: Subject to any disclaimer, the term of this patent is extended or adjusted under 35 U.S.C. 154(b) by 45 days.

(21) Appl. No.: 10/161,559

(22) Filed: Jun. 4, 2002

(65) Prior Publication Data

US 2002/0166172 A1 Nov. 14, 2002

Related U.S. Application Data

(63) Continuation of application No. 09/274,009, filed on Mar. 22, 1999, now Pat. No. 6,405,349.

(51) Int. Cl.[7] ..... A47C 27/08
(52) U.S. Cl. ..... 5/655; 5/484
(58) Field of Search ..... 5/655, 945, 947, 5/484, 487, 925; 604/358, 386, 389, 399, 402

(56) References Cited

U.S. PATENT DOCUMENTS

| | | | | | |
|---|---|---|---|---|---|
| 3,298,648 | A | | 1/1967 | Sepanski | |
| 3,779,540 | A | | 12/1973 | Boudreau | 269/328 |
| 3,989,867 | A | * | 11/1976 | Sisson | 428/132 |
| 4,133,063 | A | * | 1/1979 | Jones-Steele | 5/99.1 |
| 4,391,010 | A | * | 7/1983 | Kronman | 5/484 |
| 4,573,608 | A | | 3/1986 | Hansen | 221/92 |
| 4,712,258 | A | | 12/1987 | Eves | 5/424 |
| 4,772,281 | A | | 9/1988 | Armstead | 604/358 |
| 4,792,024 | A | | 12/1988 | Morton et al. | 190/1 |
| 4,813,944 | A | | 3/1989 | Haney et al. | 604/358 |
| 4,965,896 | A | | 10/1990 | Berger et al. | 5/424 |
| D313,516 | S | | 1/1991 | Socher | D6/384 |
| 4,999,863 | A | | 3/1991 | Kane | 5/98.1 |
| 5,082,707 | A | * | 1/1992 | Fazio | 428/43 |
| 5,125,121 | A | | 6/1992 | Wroble | 5/484 |
| D327,786 | S | | 7/1992 | Ferrell | D6/397 |
| 5,161,270 | A | | 11/1992 | Najmabadi | 5/424 |
| 5,234,224 | A | | 8/1993 | Kim | 280/30 |
| 5,252,374 | A | * | 10/1993 | Larsonneur | 428/77 |
| 5,299,336 | A | | 4/1994 | Marteeny | 5/655 |
| D375,419 | S | | 11/1996 | Levine | D5/384 |
| 5,802,647 | A | | 9/1998 | Helmsderfer | 5/947 |
| 6,298,509 | B1 | * | 10/2001 | Vickers | 5/655 |
| 6,405,394 | B1 | | 6/2002 | Rosenberg | 6/655 |

FOREIGN PATENT DOCUMENTS

| | | |
|---|---|---|
| FR | 2750585 | 9/1998 |
| GB | 2238286 | 5/1991 |

OTHER PUBLICATIONS

Depend Underpads Product Label Statement of Observations at Kaiser Permanente Hospital.

* cited by examiner

*Primary Examiner*—Teri Pham Luu
*Assistant Examiner*—Fredrick Conley
(74) *Attorney, Agent, or Firm*—Frank Rosenberg

(57) ABSTRACT

Apparatus for changing a baby including a disposable changing pad component, a changing platform component and a combination of a changing pad component and platform component. The disposable changing pad component includes a water impermeable layer and a fabric layer and at least one movement resistance aid to anchor the pad in place. The changing platform component includes a generally smooth region for receiving a baby and at least one changing pad retainer for holding the changing pad.

39 Claims, 2 Drawing Sheets

DIAPER CHANGING APPARATUS

RELATED APPLICATIONS

This application is a continuation of U.S. patent application Ser. No. 09/274,009, filed Mar. 22, 1999, now U.S. Pat. No. 6,405,394.

FIELD OF THE INVENTION

The present invention relates to a changing platform and disposable changing pad for use in changing a baby's diaper.

BACKGROUND

Although babies have many wonderful attributes, they also produce substantial quantities of waste products, especially urine and feces. These waste products are (hopefully) deposited in diapers that must then be changed by a caretaker. While caretakers typically view changing diapers as a distasteful but necessary task, many babies apparently view the process as unduly time-consuming and boring. Thus, while caretakers prefer babies to remain compliant and quiescent during diaper changes, many babies prefer to cry, squirm, attempt to crawl away and grab nearby objects in an apparent pursuit of more stimulating or less uncomfortable activities. As a result, changing time is often more difficult, messy and time-consuming than might otherwise be hoped.

There are, not surprisingly, a plethora of inventions that address the problems in the routine of changing a baby's diapers. For example, U.S. Pat. Nos. 5,161,270 and 4,712,258 describe a partition or restraining straps for controlling a baby during diaper changes, U.S. Pat. No. 3,721,434 describes an infant changing board, U.S. Pat. No. 4,965,896 describes a changing table that unfolds from a wall, and U.S. Design Pat. Nos. 313,516 and 375,419 show a baby changing table that incorporates drawers. Other patents do not address the problem of baby changing as such, but address the problem of portability of changing apparatus. For example, U.S. Pat. No. 5,299,336 describes a portable baby changing table, U.S. Pat. No. 5,234,224 describes a baby carriage that converts into a changing table, and U.S. Pat. No. 4,792,024 describes a changing caddy including a removable changing pad.

SUMMARY OF THE INVENTION

The present invention provides apparatus for changing a baby that includes a changing platform component in combination with a disposable changing pad component. The platform component has a base element with a generally smooth surface onto which a disposable changing pad and a baby are placed. The disposable changing pad component is a generally flat sheet that includes a water impermeable barrier layer and a fabric layer attached to the water impermeable barrier layer. The combination also includes at least one movement resistance aid that is an integral part of the water impermeable barrier layer, and/or at least one changing pad retainer on the platform component.

In another embodiment, the present invention provides an apparatus for changing a baby comprising a disposable changing pad component. The disposable changing pad component comprises: a water impermeable barrier layer; a fabric layer attached to the water impermeable barrier layer; and at least one movement resistance aid that is an integral part of the water impermeable barrier layer.

In another embodiment, the present invention provides apparatus for changing a baby comprising a changing platform component. The changing platform component includes a base element having a generally smooth surface for receiving a disposable changing pad component and a baby, and a disposable changing pad retainer.

The present invention also provides uses for the above described components in changing a baby and methods of changing a baby that utilize these components. For example, the present invention provides a method of changing a baby's diaper comprising the use of the changing pad described above to change a baby. Similarly, the present invention provides a method of changing a baby's diaper comprising the use of the changing platform described above to change a baby; and a method of changing a baby's diaper comprising the use of the changing pad in conjunction with the changing platform.

Glossary

The phrase "movement resistance aid that is an integral part of the water impermeable barrier layer" means either a hole through or loop on the water impermeable barrier layer into which a button, hook, post or clamp can be inserted; or a sticking agent bonded to the side of the water impermeable barrier layer opposite the side that has the fabric layer.

The fabric layer on the disposable changing pad is water absorbent and/or water permeable.

The phrase "disposable changing pad retainer on the platform component" means that—either the changing platform contains a smooth receiving surface defined by low profile sidewalls that are positioned to snugly fit a disposable changing pad between the sidewalls; or there is a sticking agent attached to the changing platform.

The term "disposable changing pad retainer" means a retainer for disposable changing pads—not a disposable retainer.

The phrase "a base element having a generally smooth surface for receiving a disposable changing pad component and a baby" means that there is an area on the surface of the changing platform that is large enough to accommodate a disposable changing pad and is generally smooth such that a baby can lie thereon without feeling uncomfortable.

DETAILED DESCRIPTION OF THE INVENTION

Figure 1:
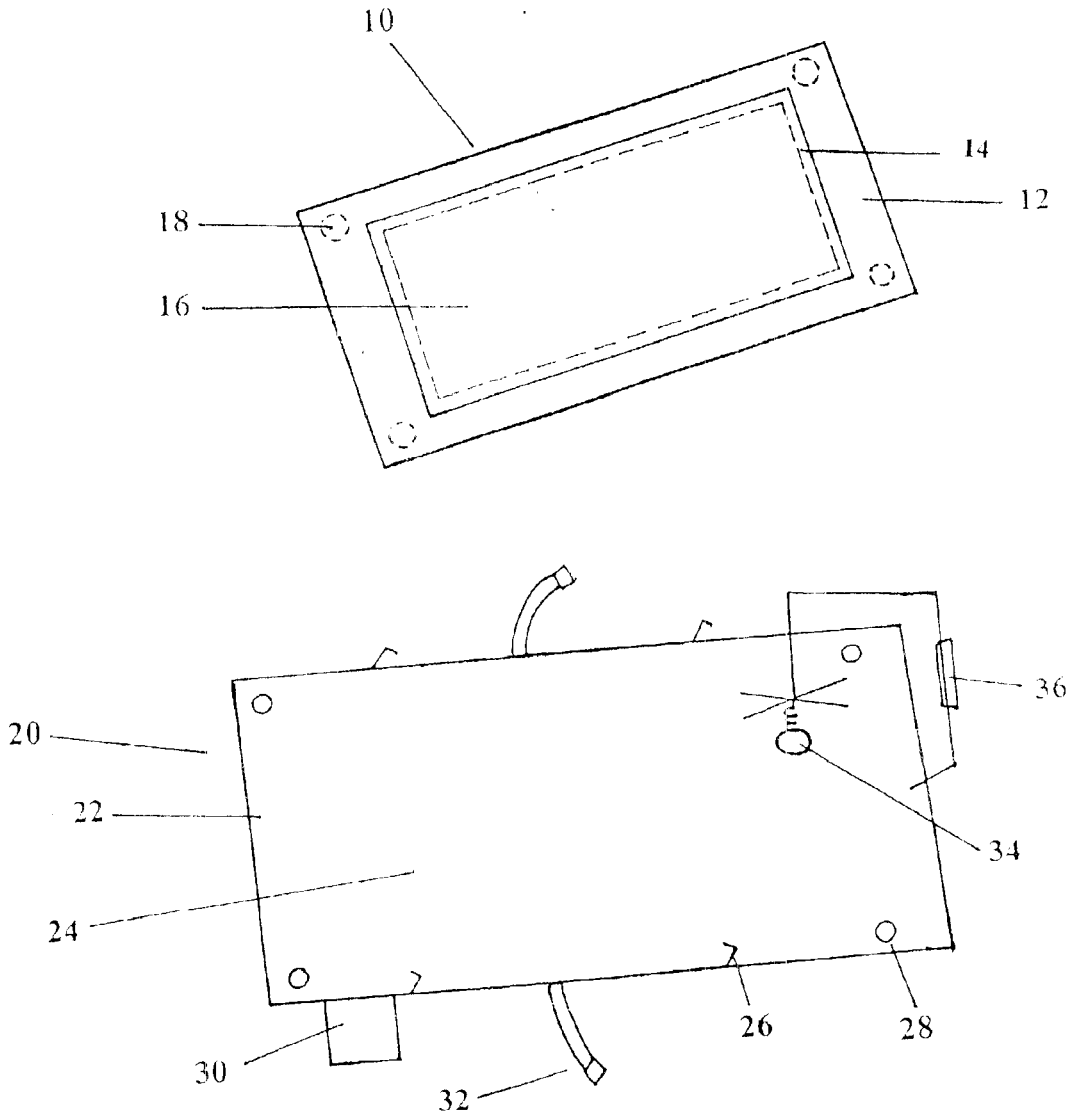
FIG. 1 illustrates a changing pad component and changing platform component in accordance with the present invention.

As shown in FIG. 1, a disposable changing pad 10 contains a water impermeable barrier sheet 12. The water impermeable sheet 12 is typically formed from a polymer or blend of polymers and may contain additional materials such as plasticizers, colorants, etc. Attached to the water impermeable sheet 12 is a fabric layer 14. The fabric layer is preferably a nonwoven fabric and is typically made of fibers of a polymer or polymer blend, preferably polypropylene, polyethylene or a blend of these. Preferably, the disposable changing pad is not stitched. For appearance, cost and control of entrapped liquid, the fabric layer preferably has smaller length and width dimensions than the water impermeable area—thus leaving a border of water impermeable sheet around the fabric layer. Typically, the disposable changing pad has dimensions of about 30 cm (1 foot) to about 60 cm (2 feet) in width and 45 cm (1.5 feet) to about 75 cm (2.5 feet) in length including borders of about 1 cm (⅜ in) to about 6 cm (2.5 in).

For better liquid-absorbing performance, the changing pad may also include a water absorbing layer 16 located between the water impermeable sheet 12 and fabric layer 14. The water absorbing layer preferably contains cotton or other absorbent batting. More preferably, the water absorbing layer contains a hygroscopic material such as a hygroscopic gel such as (unhydrated) silica gel. The water absorbing material preferably has length and width dimensions that are the same as, or more preferably slightly smaller than the fabric layer. Materials and processes for making the disposable changing pad include those that are known in the disposable diaper and disposable bed pad arts. As can be seen from the foregoing description, although the disposable changing pad has thickness, it is generally flat. Preferably the changing pad has thickness of less than 0.3 cm (¼ inch), more preferably, between 0.01 and 0.2 cm.

A primary goal of the present invention is to make it more difficult for a baby to pull up or otherwise move the changing pad. Thus, the disposable changing pad may contain at least one movement resistance aid 18. One type of movement resistance aid is a loop or hole which can accommodate a button or hook or clamp to anchor the disposable pad. A hole is preferred over a loop because it is more economical. Multiple holes are preferred. Four holes, two on each side, is the most preferred configuration. It is also preferred that the water impermeable sheet forms a border on the disposable pad and the hole or holes are located in the border area. The hole or slit should be large enough to accommodate a hook, clamp, post or button. Micropores or pinpricks through the changing pad are not considered holes for purposes of the present invention, typically holes have a diameter of about 0.2 cm to about 1 cm.

Another type movement resistance aid according to the present invention is a sticking agent that is bonded to the water impermeable sheet 12 on the side opposite the fabric (and opposite the absorbent layer if present). The sticking agent can be attached to the water impermeable sheet via an intermediate layer but is preferably attached directly to the water impermeable sheet. Preferred arrangements of the sticking agent include one agent at each corner of the water impermeable sheet (see FIG. 1), or at least one strip running along a side.

The sticking agent can be a semiadhesive as known in the art such as in Post-It™ notes. The use of a semiadhesive allows the disposable changing pad to be used on the floor, tabletop or other surface. Since the pads are disposed of once they are soiled, it is important the adhesive is not a permanent adhesive. When stored, the semiadhesive can be covered with a release liner (typically a silicone-treated paper) that is removed prior to use, or the pads can be stacked like Post-It™ notes and individually pealed off prior to use. The sticking agent can also be a slip resistance material such as a rubber pad.

Rather than chemical-type bonding, the sticking agent can also be mechanical. Examples of mechanical sticking agents include: hook and loop type fasteners (e.g. Velcro™), snaps, and sealing strips (e.g. the closures on Ziploc™ sandwich bags). Hook fasteners have the additional advantage of providing stickiness on carpeted floors.

Another aspect of the present invention involves the storage and distribution of disposable changing pads. The changing pads with semiadhesive on at least two corners or on one side can be stacked and distributed like Post-It™ notes. Disposable changing pads can also be stacked together and the stack can be mounted vertically—preferably this is done by stacking on a backboard that has rings on one edge; the rings go through holes along a border section of the changing pads (similar to paper in a calender or spiral notepad). This border section is separated from the rest of the changing pad by a perforation, and each changing pad can be conveniently torn away from the stack leaving behind the border section on the other side of the perforation. Disposable changing pads can also be distributed in a roll (like paper towels) with perforations between sheets. These latter two methods can be used for disposable changing pads with or without a movement resistance aid and this also is part of the invention. For public changing rooms, disposable changing pads can be stored in and distributed from a vending machine.

Figure 2:
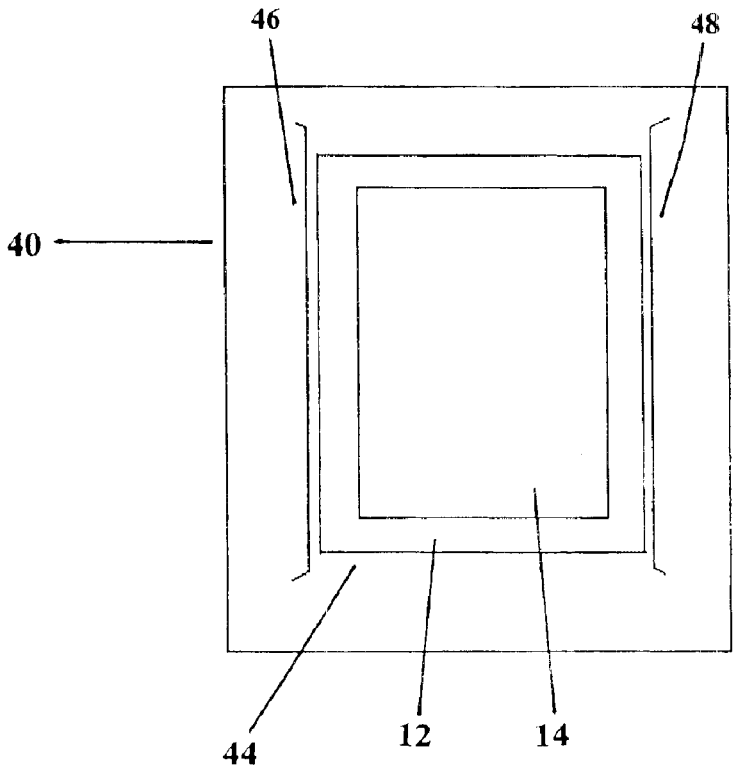
FIG. 2 is a top-down view of a changing pad component and changing platform component in accordance with another embodiment of the present invention.
Figure 3:
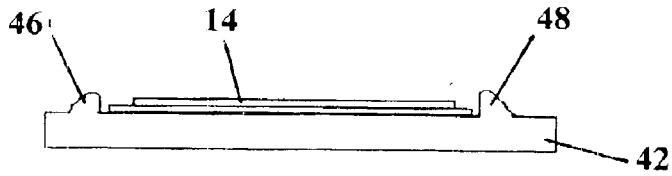
FIG. 3 is a cross-sectional view of the changing pad component and changing platform component shown in FIG. 2.

Two embodiments of changing platforms 20 and 40 are shown in FIGS. 1–3. In either embodiment, the base element 22 and 42 of the changing platform component should be easy to clean. Preferably the base element is composed of plastic, wood or stainless steel. The smooth receiving area 24 and 44 on the base element preferably has dimensions of about 32 cm (1 foot 1 inch) to about 62 cm (2 feet 2 inch) in width and about 45 cm (1.5 feet) to about 75 cm (2.5 feet) in length. The changing platform should not have any sharp edges on which a baby could be cut. The changing platform component is preferably lightweight—preferably less than 5 pounds (2 kg), more preferably, less than 3 pounds (1.2 kg). For reasons such as economy of materials and ease of storage, in a preferred embodiment the changing platform component has a maximum height (excluding the height of clamps, arms and hanging toys, if any) of 12.5 cm (5 inches), more preferably less than 0.5 cm (¼ inch).

In some embodiments of the invention, the disposable changing pad retainer is a sticking agent such as 26 or 28. For better retention, there are preferably at least four sticking agents on the platform (two on each side of the receiving area), or a strip along each side of the receiving area.

The retainer can be a chemical sticking agent such as a semiadhesive, rubber pad or nonskid surface. A semiadhesive or rubber pad is preferred over a nonskid surface because nonskid surfaces are more difficult to clean and because disposable changing pads are typically thin and unpadded; bumpy or gritty surfaces beneath the disposable changing can make the changing platform uncomfortable to lie on.

Other sticking agents are mechanical. One preferred sticking agent is a hook or loop fastener 28 such as Velcro™. Another preferred sticking agent is one half of a sealing strip (for example, the sealing strip in Ziploc™ sandwich bags). Many type of clamps 26 can also be used as the sticking agent including: spring-loaded clamps, screw-type clamps, ring clamps (for example, the clamps in 3-ring notebooks), and magnet clamps. For magnet clamps the area of the base element beneath the magnet must be an oppositely poled magnet or a ferromagnetic material, preferably an iron-based material. The spring-loaded, screw-type and magnet clamps are typically used by pressing down on the changing pad. Alternatively, the clamps, especially the ring clamp can retain a changing pad by passing through a hole in the changing pad. The sticking agent can also be a clip. Other sticking agents include buttons, hooks or short posts which can be used to retain disposable changing pads by sticking the button, hook or post through a hole in the changing pad. For purposes of the present invention, hooks also include devices that function like hooks—for example a string (or shoelace) that passes through the hole and is tied to retain the changing pad. Hooks also include hooking clips such as are sometimes seen on removable straps for pulling a suitcase on wheels.

In the embodiment shown in FIGS. 2–3, the disposable changing pad retainer is the side retaining walls 46 and 48. When the changing pad retainer is formed by side retaining walls rising up from around the receiving area of the base element of the changing platform component, the side retaining walls must not be higher than about 5 cm (2 inches) above the receiving area and should be designed such that a disposable changing pad will fit snugly between the retaining walls (see FIG. 3). The height of the side retaining walls, as measured from the receiving area from which the walls project, is about 0.05 cm to about 5 cm; more preferably about 0.1 to 1 cm. Side retaining walls higher than about 5 cm are undesirable because high retaining walls make the receiving area harder to clean and access—thus making it much more difficult to change a baby. High retaining walls also act as guides, guiding a baby's hands towards the edge of the changing pad—thus leading to undesirable changing-pad-pulling behavior. A snug fit of the disposable changing pad within low profile retaining walls helps prevent a baby from reaching the changing pad because the walls are high enough to act as a rest for a baby's hands but not so high as to guide hands towards the pad edges. Low profile changing platforms are also preferred because they are easier to store.

FIG. 3 shows the side retaining walls elevated from both the receiving area and the outer parts of the base element of the changing platform; however, this need not be the case, the receiving area could be a well sunken into the base element. The retaining walls could also define edges of the changing platform, but this configuration is less preferable since such edges would make better hand holds that a baby might use to exit a platform or overturn a lightweight platform. For ease of cleaning and better access to the baby, the base element preferably has only two retaining walls (i.e. it does not have top and bottom walls). In a preferred embodiment, the changing platform component including side retaining walls is a unitary piece of molded plastic.

The changing platform component may also have additional useful features. The platform can have a holder 30 or holders for cleaning solution, baby wipes and the like. A safety belt 32 could be attached for restraining a baby. An especially useful feature are hanging toys 34 held over the baby's face. Toys that can be looked at or, especially, played with, are a major factor in occupying the attention of an impatient or bored baby. The arm 36 preferably has adjustable height and swivels—the height adjustment allows the toys to be set at the appropriate height for each baby and swiveling allows the toys to be moved aside when placing or picking up the baby. In a preferable embodiment the arm and toys have mated fasteners so that toys can be easily replaced. The receiving area can also be padded or partially padded for additional comfort.

When the changing apparatus includes both the changing platform component and the disposable changing pad component, there are typically important design considerations to match the changing platform component and the disposable changing pad component. For example, where the movement resistance aid of the disposable changing pad component is holes in the border of the changing pad, the changing platform component should have clamps, hooks or posts that are positioned to match the holes in the changing pad component. Similarly, the disposable changing pad component and changing platform component should be designed so that loop and hook fasteners or sealing strip fasteners will match with their mate. The receiving area 24 or 44 of the base element on the changing platform should be large enough to accommodate the disposable changing pad. The receiving area of the changing platform component must be large enough to accommodate the disposable changing pad. When side retaining walls are present on the changing platform component, the side retaining walls should be separated by a distance that is the same as, or less than 2.5 cm (1 inch) more than, the width of the disposable changing pad for which the changing platform is designed.

The foregoing descriptions use numbers that refer to the drawings; however, the invention is not to be unduly limited by the descriptions in the Detailed Description section or in the drawings. It should be understood that various changes can be made and equivalents substituted without departing from the spirit and scope of the invention.

What is claimed:

1. Apparatus for changing a baby's diaper comprising:

a changing platform component in combination with a disposable changing pad component;

wherein said platform component comprises a base element having a generally smooth surface for receiving a disposable changing pad component and a baby;

wherein said disposable changing pad component comprises a water impermeable barrier layer and a fabric layer attached to said water impermeable barrier layer;

wherein said fabric layer is on the side of the water impermeable barrier layer that is opposite the side facing the platform component;

and wherein said combination comprises:

at least one disposable changing pad retainer on said platform component; wherein said platform component comprises side retaining walls projecting up from around said generally smooth surface for receiving a disposable changing pad component and a baby;

wherein said retaining walls have a height of about 0.05 cm to about 5 cm; and wherein said side retaining walls are separated by a distance that is 0 to 2.5 cm larger than the width of the disposable changing pad component.

2. The apparatus of claim 1 comprising:

at least one first mechanical sticking agent bonded to the side of the water impermeable barrier layer opposite the side comprising the nonwoven fabric;

at least one second mechanical sticking agent bonded to the surface of said base element;

wherein said first mechanical sticking agent and said second mechanical sticking agent are positioned to mate with each other; and wherein said first mechanical sticking agent and said second mechanical sticking agent are a mating pair selected from the group consisting of hook and loop fasteners, and sealing strips.

3. The apparatus of claim 1 wherein the disposable changing pad component further comprises a water absorbing layer disposed between the water impermeable barrier layer and the fabric layer.

4. The apparatus of claim 3 wherein mechanical sticking agents are disposed on both the changing pad component and the changing platform component, and wherein the mechanical sticking agents are selected from the group consisting of hook and loop type fasteners and sealing strips.

5. The apparatus of claim 4 mechanical sticking agent comprises a spring-loaded, screw-type or magnet clamp that presses down on the changing pad component.

6. The apparatus of claim 3 wherein the changing platform component comprises a mechanical sticking agent and wherein the mechanical sticking agent comprises a clamp or clip.

7. The apparatus of claim 3 wherein the water absorbing layer comprises a hygroscopic material.

8. The apparatus of claim 3 wherein the disposable changing pad component comprises holes and the changing platform component comprises clamps, hooks or posts that are positioned to match the holes in the changing pad component;

and further wherein the water impermeable sheet forms a border on the disposable pad component and further wherein the holes are located in the border area.

9. The apparatus of claim 8 wherein the changing pad component is rectangular in shape and comprises one hole near each corner of the water impermeable sheet.

10. The apparatus of claim 1 wherein the disposable changing pad component comprises holes and the changing platform component comprises clamps, hooks or posts that are positioned to match the holes in the changing pad component.

11. The apparatus of claims 1 wherein the side retaining walls have a height of about 0.1 to 1 cm.

12. The apparatus of claim 1 wherein the generally smooth surface for receiving a disposable changing pad component and a baby is a well sunken into a base element.

13. The apparatus of claim 1 wherein the platform component comprises side retaining walls that are elevated relative to the generally smooth surface and relative to outer parts of the base element.

14. The apparatus of claim 1 wherein the changing platform component including side retaining walls is a unitary piece of molded plastic.

15. The apparatus of claim 1 wherein the platform component comprises side retaining walls that are elevated relative to the generally smooth surface and relative to outer parts of the base element.

16. The apparatus of claim 15 wherein the changing platform component including side retaining walls is a unitary piece of molded plastic.

17. Apparatus for changing a baby's diaper comprising:

a changing platform component in combination with a disposable changing pad component;

wherein said platform component comprises a base element having a generally smooth surface for receiving a disposable changing pad component and a baby;

wherein said disposable changing pad component comprises a water impermeable barrier layer and a fabric layer attached to said water impermeable barrier layer;

wherein said fabric layer is on the side of the water impermeable barrier layer that is opposite the side facing the platform component;

and wherein said combination comprises at least one movement resistance aid that is an integral part of the water impermeable barrier layer;

wherein the at least one movement resistance aid comprises a semiadhesive bonded to the side of the water impermeable barrier layer opposite the side comprising the nonwoven fabric.

18. Apparatus for changing a baby's diaper comprising:

a changing platform component in combination with a disposable changing pad component;

wherein said platform component comprises a base element having a generally smooth surface for receiving a disposable changing pad component and a baby;

wherein said disposable changing pad component comprises a water impermeable barrier layer and a fabric layer attached to said water impermeable barrier layer;

wherein said fabric layer is on the side of the water impermeable barrier layer that is opposite the side facing the platform component;

and wherein said combination comprises at least one of;

at least one movement resistance aid that is an integral part of the water impermeable barrier layer; or at least one disposable changing pad retainer on said platform component:

wherein said disposable changing pad component comprises at least two holes and wherein said base element comprises at least two sticking agents that are positioned to pass through said at least two holes; and wherein said at least two sticking agents are selected from the group consisting of ring clamps, hooks, buttons, and posts.

19. Apparatus for changing a baby's diaper comprising a disposable changing pad component wherein said disposable changing pad component comprises:

a water impermeable layer;

a fabric layer attached to said water impermeable barrier layer; and at least one movement resistance aid that is an integral part of the water impermeable barrier layer;

wherein the at least one movement resistance aid comprises a hole or loop into which a button, hook, post or clamp can be inserted; or a sticking agent bonded to the side of the water impermeable barrier layer opposite the side that has the fabric layer.

20. The apparatus of claim 19 wherein said fabric is a nonwoven fabric.

21. The apparatus of claim 20 wherein said movement resistance aid comprises a semiadhesive bonded to the side of the water impermeable barrier layer opposite the side comprising the nonwoven fabric.

22. The apparatus of claim 21 wherein the semiadhesive is covered with a release liner.

23. The apparatus of claim 20 further comprising an absorbent layer disposed between said fabric layer and said water impermeable barrier layer.

24. The apparatus of claim 23 wherein multiple sheets of changing pads are in a roll, and wherein each sheet is separated by a perforation from each adjacent sheet.

25. The apparatus of claim 23 wherein said disposable changing pad has a thickness of about 0.01 to about 0.3 centimeters (cm);

wherein said water impermeable barrier layer has a width of about 30 cm to about 60 cm and a length of about 45 cm to about 75 cm;

wherein said water impermeable barrier layer is wider and longer than the nonwoven fabric layer such that the water impermeable barrier layer forms a border area around the nonwoven fabric layer; and wherein the border area comprises at least one hole.

26. The apparatus of claim 23 herein the disposable changing pad component is rectangular in shape and comprises a sticking agent at each corner of the water.

27. The apparatus of claim 23 wherein the movement resistance aid comprises a rubber pad, a hook or loop type fastener, or a sealing strip.

28. The apparatus of claim 20 wherein the disposable changing pad component is not stitched.

29. The apparatus of claim 19 wherein the movement resistance aid comprises a semiadhesive bonded to the side of the water impermeable layer opposite the side comprising the fabric layer; and wherein the disposable changing pad component is stacked in a stack with other disposable changing pad components such that the disposable changing pad component can be individually pealed off prior to use.

30. The apparatus of claim 19 wherein the movement resistance aid comprises a semiadhesive bonded to the side of the water impermeable layer opposite the side comprising the fabric layer; and wherein the disposable changing pad component is stacked in a stack with other disposable changing pad components such that the disposable changing pad component can be individually pealed off prior to use.

31. The apparatus of claim 30 wherein the changing pad component is rectangular in shape and the semiadhesive is disposed on at least two corners or on one side of the water impermeable barrier layer.

32. Apparatus for changing a baby's diaper comprising a changing platform component wherein said changing platform component comprises:

a base element having a generally smooth surface for receiving a disposable changing pad component and a baby; and a disposable changing pad retainer, and wherein said disposable changing pad retainer comprises a clamp selected from the group consisting of spring-loaded clamps, screw-type clamps, and ring clamps, or wherein the disposable changing pad retainer comprises a magnet clamp and the base element comprises an oppositely poled magnet or a ferromagnetic material.

33. The apparatus of claim 32 further comprising a disposable changing pad, comprising a water impermeable barrier layer and a fabric layer attached to said water impermeable barrier layer, disposed on said base element;

wherein said fabric layer is on the side of the water impermeable barrier layer that is opposite the side facing the base element.

34. The apparatus of claim 33 wherein the disposable changing pad comprises a water impermeable barrier layer and a non-woven fabric layer attached to said water impermeable barrier layer;

wherein said water impermeable barrier layer is wider and longer than the nonwoven fabric layer such that the water impermeable barrier layer forms a border area around the nonwoven fabric layer; and wherein the border area comprises at least one hole having a diameter of about 0.2 cm to about 1 cm.

35. The apparatus of claim 32 weighing less than 3 pounds.

36. The apparatus of claim 32 wherein the disposable changing pad retainer is selected from the group consisting of spring-loaded clamps, screw-type clamps, and ring clamps.

37. The apparatus of claim 32 wherein the disposable changing pad retainer comprises a magnet clamp and the base element comprises an oppositely poled magnet or a ferromagnetic material.

38. The apparatus of claim 32 further comprising a safety belt.

39. The apparatus of claim 32 further comprising an arm for hanging toys.

* * * * *